US008827109B1

(12) United States Patent
Sheehan

(10) Patent No.: US 8,827,109 B1
(45) Date of Patent: Sep. 9, 2014

(54) ICE CHEST COVER WITH BODY AND LID POCKETS

(71) Applicant: Donna Sheehan, Southlake, TX (US)

(72) Inventor: Donna Sheehan, Southlake, TX (US)

( * ) Notice: Subject to any disclaimer, the term of this patent is extended or adjusted under 35 U.S.C. 154(b) by 0 days.

(21) Appl. No.: 14/200,240

(22) Filed: Mar. 7, 2014

(51) Int. Cl.
*F25D 3/08* (2006.01)

(52) U.S. Cl.
CPC ..... *F25D 3/08* (2013.01)
USPC ..... 220/739; 220/592.24; 150/154; 206/216

(58) Field of Classification Search
CPC ..... F25D 3/08; F25D 3/06; A45C 11/20; B65D 81/3886; B65D 81/3876
USPC ..... 220/739, 737, 694, 592.24, 592.2, 220/592.03, 592.02, 915.2, 915.1; 62/457.7, 457.1; 150/165, 154, 901; 206/216
See application file for complete search history.

(56) References Cited

U.S. PATENT DOCUMENTS

| | | | |
|---|---|---|---|
| 698,564 | A | 4/1902 | Secor |
| 2,416,816 | A | 3/1947 | Campagnano |
| 4,328,923 | A | 5/1982 | Graser |
| 4,521,910 | A | 6/1985 | Keppel et al. |
| 4,598,746 | A | 7/1986 | Rabinowitz |
| 4,759,467 | A | 7/1988 | Byrne |
| 4,765,474 | A | 8/1988 | James |
| 4,773,515 | A | 9/1988 | Kotkins, Jr. |
| 5,251,460 | A | 10/1993 | DeMarco et al. |
| 5,421,172 | A | 6/1995 | Jones |
| 5,526,907 | A | 6/1996 | Trawick et al. |
| 6,027,249 | A | 2/2000 | Bielinski |
| 6,067,813 | A | 5/2000 | Smith |
| 6,129,210 | A | 10/2000 | Rustemeyer et al. |
| 6,276,164 | B1 | 8/2001 | Santa Cruz et al. |
| 6,397,560 | B1 | 6/2002 | Weder |
| 6,422,032 | B1 | 7/2002 | Greene |
| 6,427,475 | B1 | 8/2002 | DeFelice et al. |
| 6,789,693 | B2 | 9/2004 | Lassiter |
| 6,925,834 | B2 | 8/2005 | Fuchs |
| 7,240,513 | B1 | 7/2007 | Conforti |
| 7,302,810 | B2 | 12/2007 | McCrory |
| D612,671 | S | 3/2010 | Sanchez et al. |
| D613,109 | S | 4/2010 | Sanchez et al. |
| 7,988,006 | B2 | 8/2011 | Mogil et al. |
| 8,061,547 | B2 | 11/2011 | Camp, Jr. |
| D662,365 | S | 6/2012 | Howes |
| D669,314 | S | 10/2012 | Quigley et al. |
| 8,556,337 | B1 | 10/2013 | Cornitius-Cary |
| 2002/0108279 | A1 | 8/2002 | Hubbard, II et al. |
| 2003/0150568 | A1 | 8/2003 | Hileman, Jr. |
| 2006/0283194 | A1 | 12/2006 | Flanagan |
| 2006/0289428 | A1 | 12/2006 | Longua |

(Continued)

*Primary Examiner* — Robert J Hicks
(74) *Attorney, Agent, or Firm* — Haynes and Boone, LLP

(57) ABSTRACT

A one-piece ice chest cover for changing the appearance of an ice chest includes a flexible main pocket portion having a front side, two lateral sides, and a back side forming a main pocket opening for receiving a main body of the ice chest. It also includes a flexible lid pocket portion formed of an inner portion configured to face an inner-facing surface of a lid of the ice chest and an outer portion for covering an outer-facing surface of the lid. The lid pocket portion may include a lid pocket opening sized smaller than a size of the main pocket opening. The lid pocket opening may be sized to receive a portion of the lid of the ice chest. The outer portion of the lid pocket portion may be connected to the back side of the main pocket portion so that the ice chest cover flexes when the lid is pivoted to open and close the ice chest.

20 Claims, 4 Drawing Sheets

(56) References Cited

U.S. PATENT DOCUMENTS

| | | | |
|---|---|---|---|
| 2008/0029526 | A1 | 2/2008 | Campbell |
| 2008/0066490 | A1 | 3/2008 | Santeler |
| 2010/0133326 | A1 | 6/2010 | Sanchez et al. |
| 2010/0288668 | A1 | 11/2010 | Aucoin |
| 2011/0164837 | A1 | 7/2011 | Xiangjing |
| 2011/0167863 | A1 | 7/2011 | Herrbold |
| 2011/0180550 | A1 | 7/2011 | Kenneally |
| 2011/0197626 | A1 | 8/2011 | Jones et al. |

ICE CHEST COVER WITH BODY AND LID POCKETS

FIELD OF THE INVENTION

The present invention pertains to a decorative cover for an ice chest and more particularly, to a decorative cover that includes a logo, symbol or other symbolic affiliation or promotional indicia.

BACKGROUND

Ice chests or coolers are commonly used in various outdoor and indoor settings to maintain food and drinks at desired temperatures. They may be used at sporting events, concerts, festivals, picnics, parties, beaches, weddings, and many other events or gatherings. However, in some instances, the ice chests or coolers may have some shortcoming. For example, depending on the event and whether the event is a formal even, the ice chest or cooler may appear undesirably worn, may be a wrong color, or may be otherwise unsightly.

In some instances, companies, schools, and other entities sponsor events and seek to display their logos, names, symbols or other indicia on ice chests or coolers as a method of marketing or advertising. This is often done by placing stickers or taping signs onto the ice chests or coolers that include the logo, name, symbol, or other indicia. However, this method may appear unprofessional and in addition, once adhered, the stickers can be challenging to remove and tape can leave residue on the cooler or ice chest that attracts dirt.

A favorite use of ice chests and coolers is at events such as sporting events, including tailgating, watch parties, and other events involving sports. It may be desirable to display a team logo, name, symbol, or other indicia as a demonstration of team pride. Again, the use of stickers or signs can appear unprofessional and may be difficult to remove so that the ice chest or cooler can be used at separate events.

This disclosure is directed to an ice chest cover that addresses one or more of the shortcomings in the art.

SUMMARY

In some exemplary aspects, the present disclosure is directed to an ice chest cover that is easy to place around an ice chest, easy to remove, and can dress-up the ice chest or display a logos, names, symbols or other indicia.

In an exemplary aspect, the present disclosure is directed to a one-piece ice chest cover for changing the appearance of an ice chest. The ice chest cover may include a flexible main pocket portion having a front side, two lateral sides, and a back side forming a main pocket opening for receiving a main body of the ice chest. It may also include a flexible lid pocket portion formed of an inner portion configured to face an inner-facing surface of a lid of the ice chest and an outer portion for covering an outer-facing surface of the lid. The lid pocket portion may include a lid pocket opening sized smaller than a size of the main pocket opening. The lid pocket opening may be sized to receive a portion of the lid of the ice chest. The outer portion of the lid pocket portion may be connected to the back side of the main pocket portion so that the ice chest cover flexes when the lid is pivoted to open and close the ice chest.

In an aspect, the inner and outer portions of the lid pocket portion are sewn together at side edges and folded at a front edge to form the lid pocket portion. In an aspect, the lateral sides of the main pocket portion are folded at an edge of one of the front sides, a bottom, and the back side, and the lateral sides of the main pocket portion are sewn to at least two of the front sides, the bottom, and the back side to form the main pocket portion. In an aspect, the main pocket portion and the lid pocket portion are formed of a single, unitary material. In an aspect, the main pocket portion and the lid pocket portion are formed of a fabric. In an aspect, the fabric is a stretchable fabric. In an aspect, the main pocket portion includes a bottom connected to the lateral sides, the front side, and the back side. In an aspect, at least one of the lateral sides includes a handle-cutout sized to receive a handle of the ice chest. In an aspect, the bottom includes a cut-out portion configured to accommodate wheels disposed at least in part along a bottom of the ice chest. In an aspect, the one-piece ice chest cover includes a logo, name, or indicia disposed on at least one of the top of the flexible lid pocket portions and the front side to face outwardly when the cover is disposed on the ice chest. In an aspect, the logo, name, or indicia comprises a team logo.

In another exemplary aspect, the present disclosure is directed to a one-piece ice chest cover for changing the appearance of an ice chest having a body and a lid attached at a connection. The one-piece ice chest cover may include a main pocket portion formed of a stretchable fabric material, the main pocket portion having a front side, lateral sides, and a back side forming a main pocket opening sized to receive a body of the ice chest. The lateral sides may be sewn to at least two of the front sides, the back side, and a bottom to form the main pocket portion. The one-piece ice chest cover may also include a lid pocket portion configured to cover at least a top portion of the lid of the ice chest when the body of the ice chest is disposed within the main pocket portion. The lid pocket portion may be formed of a stretchable fabric material and may be connected with and extend from the back side of the main pocket portion in a manner that covers the connection of the ice chest. The lid pocket portion may have an outer portion and an inner portion folded to overlap each other, the outer portion and the inner portion each having side edges sewn together to form an opening to the lid pocket portion. The opening may be sized to receive a portion of the lid of the ice chest.

In another exemplary aspect, the present disclosure is directed to an assembly including an ice chest and an ice chest cover. The ice chest includes a main body comprising a front, a back, sides, and an opening for receiving items, and includes a lid pivotably connected to the main body. The lid has an outer facing surface and an inner facing surface and is shaped and sized to open and close to provide access into the main body portion. The ice chest cover may comprise a flexible main pocket portion having a front side, two lateral sides, and a back side forming a main pocket opening for receiving the main body of the ice chest. It may also comprise a flexible lid pocket portion formed of an inner portion configured to face the inner facing surface of the lid and an outer portion for covering the outer facing surface of the lid. The lid pocket portion may have a lid pocket opening sized smaller than a size of the main pocket opening. The lid pocket opening may be sized to receive a portion of the lid. The outer portion of the lid pocket portion may be connected to the back side of the main pocket portion so that the ice chest cover flexes when the lid is pivoted to open and close the ice chest.

It is to be understood that both the foregoing general description and the following detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following detailed description.

BRIEF DESCRIPTION OF THE DRAWINGS

The accompanying drawings illustrate embodiments of the devices and methods disclosed herein and together with the description, serve to explain the principles of the present disclosure.

DETAILED DESCRIPTION

Figure 1:
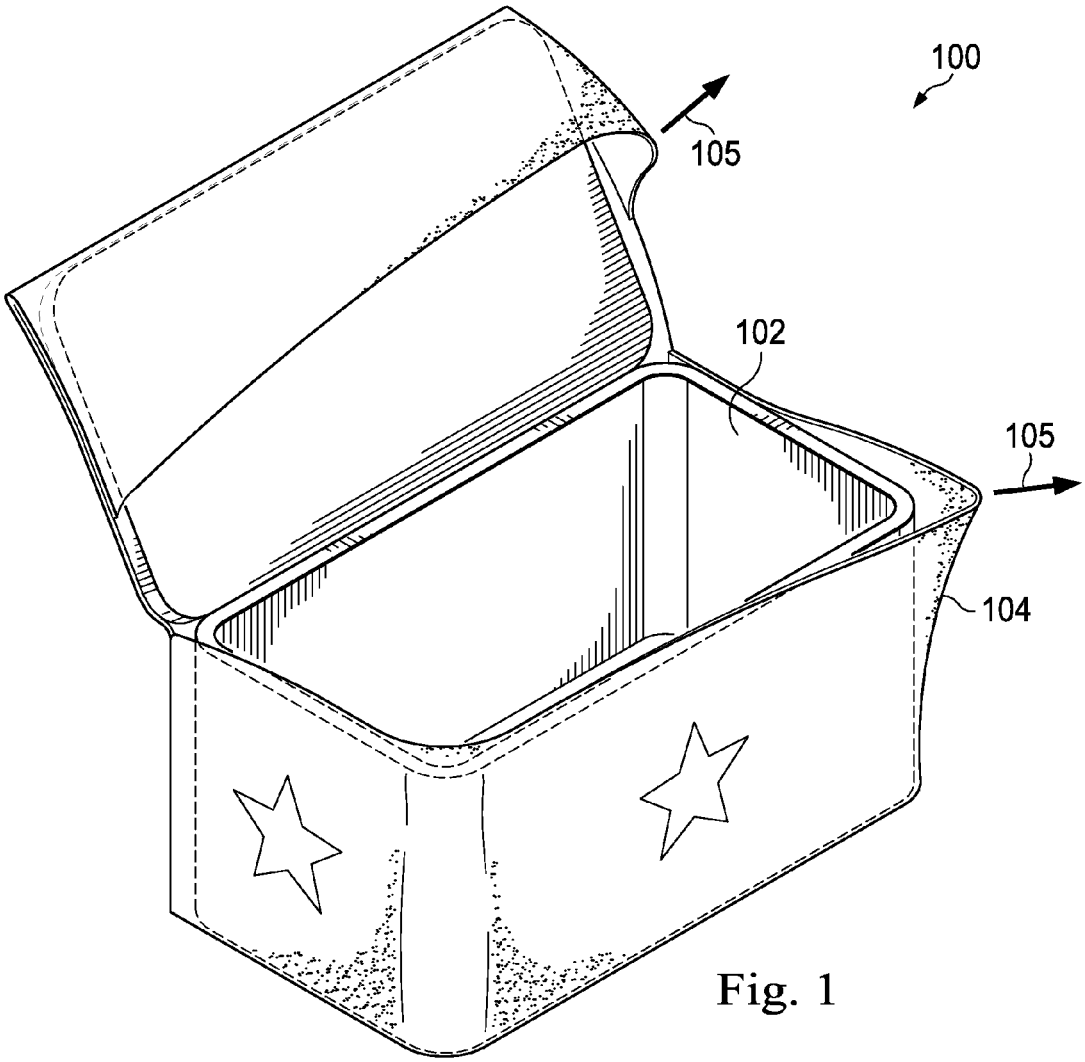
FIG. 1 is an illustration of a system including an exemplary ice chest cover on an ice chest according to an exemplary aspect of the present disclosure.

For the purposes of promoting an understanding of the principles of the present disclosure, reference will now be made to the embodiments illustrated in the drawings, and specific language will be used to describe the same. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In particular, it is fully contemplated that the features, components, and/or steps described with respect to one embodiment may be combined with the features, components, and/or steps described with respect to other embodiments of the present disclosure. For simplicity, in some instances the same reference numbers are used throughout the drawings to refer to the same or like parts.

The present disclosure is directed to an ice chest cover that is easy to place around an ice chest, easy to remove, and can dress-up the ice chest and/or display a logo, name, symbol, or other indicia. Accordingly, the ice chest may temporarily display the logo, name, symbol, or other indicia. In some instances, the cover may be used at tailgating or sporting events where a team logo may be displayed to express support and show team pride. It may also be used simply to cover an old or worn ice chest with a fabric pattern, theme, or color that may be more suitable for an event, such as a wedding party. In some instances, it may include a sponsor's logo or name and may be displayed at events or festivals. Event sponsors may cover standard ice chests with ice chest covers displaying their name for marketing or advertising purposes.

Some of the ice chest cover embodiments disclosed herein are single-piece covers that simultaneously cover both the ice chest body and the lid, while still preserving the ability to open and close the ice chest. Some embodiments are made from stretchable materials that may tightly form-fit around the ice chest body and lid. In addition, it is light, easy to replace, and in some instances, may be treated as a disposable ice-chest cover. It may be formed in any color desired to match a color, pattern, or design suitable for the particular event.

FIG. 1 shows the ice chest cover as a system 100. The system 100 includes an ice chest 102 and a cover 104. In this embodiment, the cover 104 is a one-piece cover formed of a flexible, stretchable fabric that may cover at least a part of each of the exterior surfaces of the ice chest 102. The cover 104 in FIG. 1 is shown as being stretched by the arrows 105 to show the elastic nature of the cover and its fit about the ice chest 102.

Figure 2:
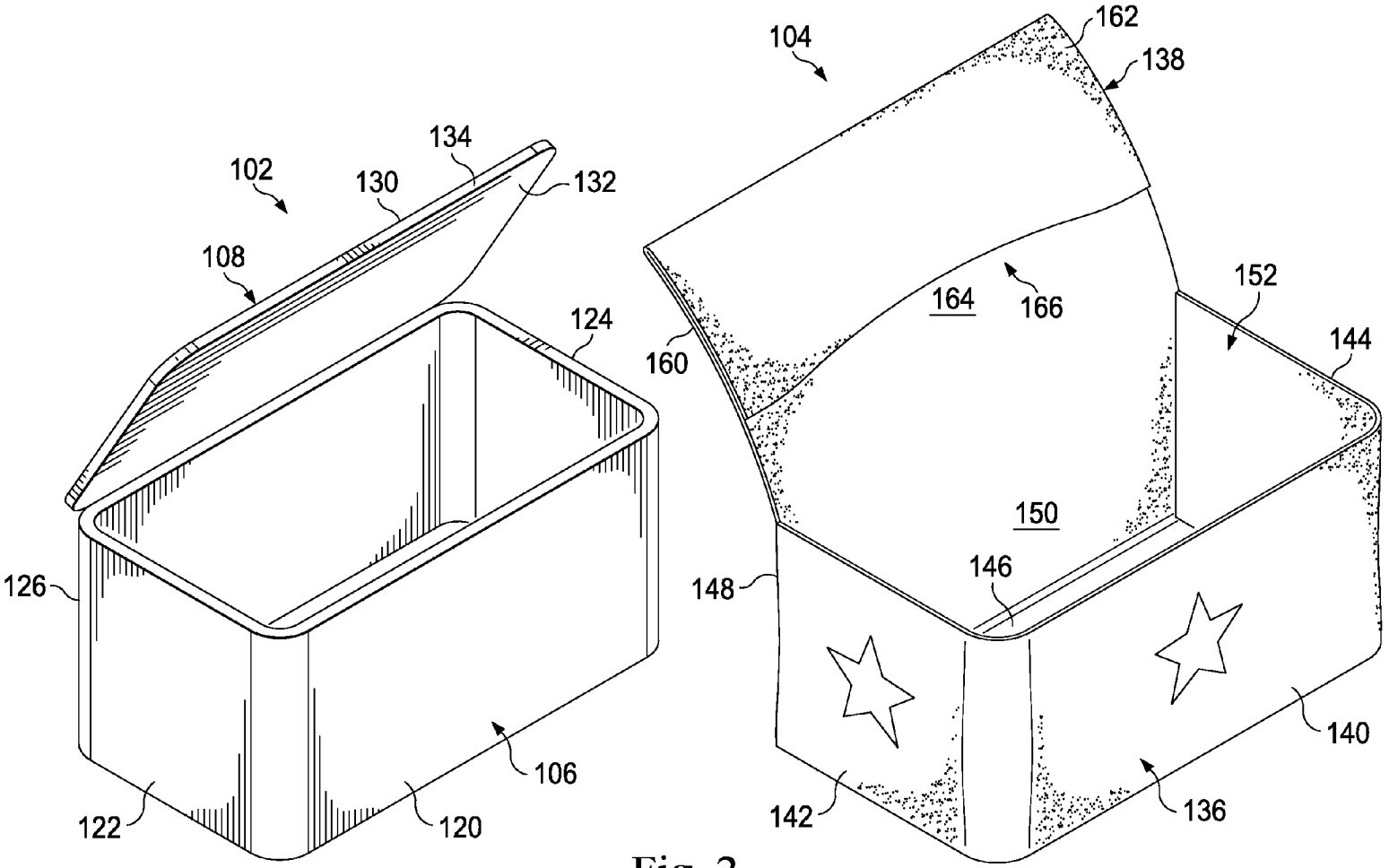
FIG. 2 is an illustration of the exemplary system of FIG. 1 with the cover independent from the ice chest according to an exemplary aspect of the present disclosure.

FIG. 2 shows the ice chest 102 independent and separate from the cover 104. The ice chest includes a main body 106 and a lid 108. The main body 106 includes a front side 120, a left side 122, a right side 124, a bottom (exterior not visible in FIG. 2), and a back side 126. Naturally, these sides and the bottom cooperate to form the exterior of the receptacle into which food, drinks, ice, or other items are kept. Although not shown in FIG. 2, some ice chest embodiments include handles that may be formed as recesses in the sides or may be swing handles attached to the sides, or other types of handles. Some ice chest embodiments include wheels along one side and a handle along the opposing side. Yet others include wheels and a telescoping or retractable pull handle attached to the same side as the wheels. Some embodiments include a drainage arranged toward the bottom of the ice chest. It may be on the back side or may be disposed along any side or directly through the bottom side.

In the embodiment shown, the lid 108 is pivotably connected via one or more connections, such as a hinge or other connector, to the main body 106. Accordingly, the lid 108 may be opened or closed over the receptacle. The lid 108 includes an outer surface 130, an inner surface 132, and a front edge 134. The lid may also include a latch, a handle, or other features that enable the lid 108 to cooperate with the main body 106.

Still referring to FIG. 2, the cover 104 is a flexible material, such as a fabric material and is shaped and configured to receive and extend about the exterior surfaces of the ice chest 102. In some embodiments, the cover 104 is formed to fit the general shape of the ice chest 102.

The cover 104 includes a body portion 136 and a lid portion 138. The body portion 136, like the ice chest main body 106, comprises a front side 140, a left side 142, a right side 144, a bottom 146, and a back side 148. The body portion 136 forms a first main pocket 150 with an opening 152 sized to receive the main body 106 of the ice chest 102. In the embodiment shown, the body portion 136 has a rectangular shape sized to receive the main body 106.

The lid portion 138 comprises at least an outer portion 160 and an inner portion 162. Together, these from a second lid pocket 164 having an opening 166 sized to receive the lid 108 of the ice chest 102. Here, the outer portion 160 may completely or entirely cover the exterior surface 130 of the lid 108. The inner portion 162, however, is formed so that at least a portion of the lid 108, such as the leading edge 134, fits within the second lid pocket 164 in a manner that maintains the lid portion 138 on the lid 108, so that the lid portion 138 stays attached to the lid 108 even while the ice chest 102 is opened and closed. As such, while the outer portion 160 covers the exterior surface 130, the inner portion 162 may extend over at least a portion of the inner surface 132 of the lid 108. Some embodiments may cover most of the inner surface 132 of the lid 108, while other embodiments cover a smaller percentage. Some embodiments include longitudinally extending straps or bands connecting the opposing sides of the lid portion 138, where the straps may extend across the inner surface 132 of the lid 108. This may secure the lid portion 138 snugly on the lid 108.

As can be seen, both the lid portion 138 and the body portion 136 are connected to each other in a manner that covers the pivotable or hinged region connecting the lid 108 to the main body 106 of the ice chest 102. Accordingly, when the lid 108 is opened, the material flexes and the exterior of the ice chest 102 remains covered or substantially covered.

Figure 3:
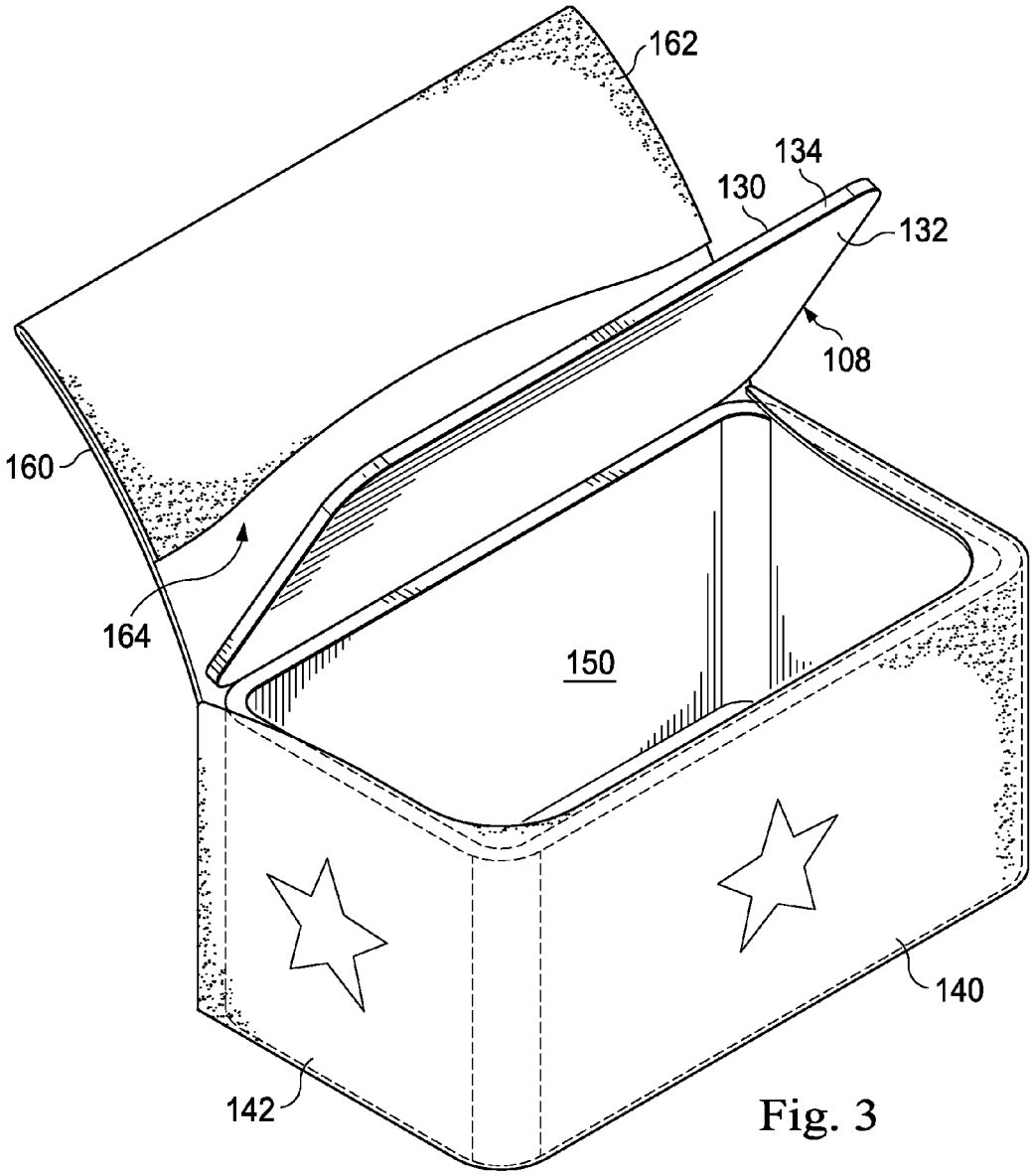
FIG. 3 is an illustration of the cover of FIG. 2 according to an exemplary aspect of the present disclosure.

FIG. 3 shows the cover 104 in a partially assembled state on the ice chest 102. As can be seen, the main body 106 of the ice chest is within the main pocket 150 of the cover 104. The lid portion 138 of the cover 104 however has not yet been attached over the lid 108. After placing the main body 106 into the main pocket, the lid portion may be stretched so that the lid 108 can be inserted into the lid portion 138.

Figure 4:
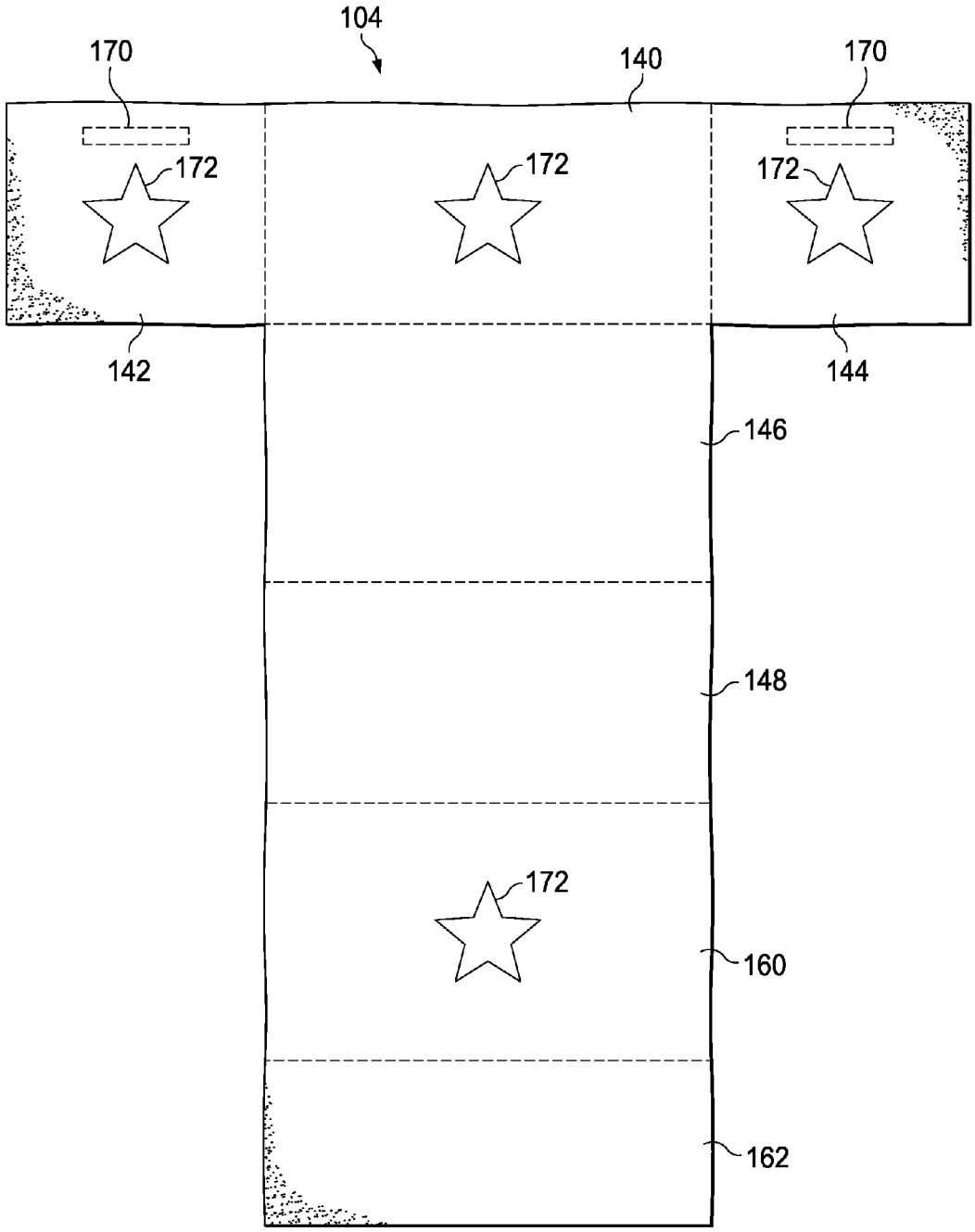
FIG. 4 is an illustration of the cover of FIG. 2 in an unassembled condition according to an exemplary aspect of the present disclosure.

FIG. 4 shows an exemplary flexible material for forming the cover 104. In this embodiment, the cover 104 is formed of a single, unitary piece of material. As described above, although a single piece of material may be used to form the cover 104, some embodiments include multiple layers of material for increased durability, color protection, or for other reasons. In FIG. 4, the material forms a T-shape and can be sewn in a manner that creates the body portion 136 and the lid portion 138.

In the embodiment shown, the material may include various portions designed to form various parts of the finished cover 102. Here, in its pre-sewn form, the cover includes sections that create the front side 140, the left side 142, the right side 144, the bottom 146, and a back side 148. In addition, in the same piece of material includes the outer portion 160 and the inner portion 162. In FIG. 4, the dashed lines between sections indicate potential lines where the material may be folded when manufacturing the one-piece ice chest cover 104.

By folding and sewing the edges together in a manner that would be apparent to one of ordinary skill in the art, the main pocket 150 and the lid pocket 164 may be formed. More particularly, the lid pocket 164 forming the lid portion 138 may be created from the material in FIG. 4 by folding the inner portion 162 along the dashed line so that it overlaps the outer portion 160 and then sewing along the side edges to form the lid pocket 164. The main pocket 150 forming the body portion 136 may be created by folding the left and right sides 142, 144 and sewing their bottom edge to the edge of the bottom 146. The side edges of the left and right sides 142, 144 may then be sewn to the back side 148. Other embodiments include the left and right sides 142, 144 being unitary with the bottom 146 or the back side 148 instead of the front side 140.

Still referring to FIG. 4, some embodiments include handle cut-outs 170 in the sides 142, 146 of the cover 104. These may be shaped or formed to fit a particular type or shape of ice chest. In this embodiment shown, the cutouts 170 are drawn in dashed lines indicating that they are optional. Also, although shown on both sides of the cover 104, the handle cut-outs 170 may be on only one side. In some embodiments, a handle cutout may be formed in the area or along the fold between the back portion and the top portion. This may accommodate ice chest types having an extendable handle. Cutouts for wheels are also contemplated. This may be disposed, for example, along or near the bottom 146 either on one side or adjacent the back side 148 to accommodate different types of ice chests.

Embodiments of the cover 104 formed of a single piece of material may be easy to manufacture. This may permit manufacturing to be done efficiently, thereby reducing costs, which may be passed to a consumer via cost savings. In some embodiments the cover 104 is inexpensive so that it may be suitable for single use events, making it relatively disposable.

The cover 104 may be formed of any type of material and may be sewn or fit to any particular brand and style or shape of ice chest. In some embodiments, the cover is formed of a fabric material and may be removed, laundered, and reused. Some embodiments are formed of a stretch fabric to ensure a secure fit around the ice chest. Examples of suitable stretch fabrics include fabrics having lycra content, spandex content, or others. Some fabrics are 4-way stretch fabrics. Other fabric types are also contemplated.

Because of the elastic nature of stretch fabric, embodiments of the cover 104 may have dimensions smaller than the dimensions of the associated ice chest when in an un-stretched condition. For example, the dimensions of the cover 104 may be between about 75-90% of the dimensions of the ice chest 102. In such embodiments, the cover 104 may stretch to form fit onto the ice chest 102, thereby providing the smooth, unwrinkled cover. In some embodiments, the cover 104 is formed of more than one layer of fabric. This may strengthen the fabric to reduce the chance of tearing or creating runs in the fabric. In addition, multiple layers may more completely block the underlying color.

In some embodiments, the ice chest has an exterior length in the range of about 12 to 50 inches, a width in the range of about 10 to 30 inches, and a height in a range of about 7 to 24 inches. Some embodiments have a length in a range of about 15 to 30 inches, a width of about 10 to 24 inches, and a height of about 12 to 20 inches. Other sizes, both larger and smaller are also contemplated. As explained above, the cover may be sized to fit about the ice chest. In one example, the cover has a main pocket width of about 18 inches, a main pocket width of about 10-12 inches, and a main pocket depth of about of about 12-13 inches. In this example, the lid pocket 164 may have a pocket depth of about 3-5 inches, as determined by the inner portion. Other sizes, both larger and smaller are contemplated in order to fit the many sizes of ice chests in the marketplace.

In the embodiments shown, the cover 104 includes indicia 172, such as a logo, advertisement, or marketing message. The indicia 172 may be printed, heat ironed, silk screened, embroidered, or otherwise formed on or attached to the cover 104. In the embodiments shown, the indicia 172 is disposed on the front side 140, the lateral sides 142, 144, and the upper facing side 160. However, it may be placed on any side and may extend around sides or corners. Accordingly, the cover 104 may be particular suitable for use during sporting events, tailgating parties, or other events where a consumer may wish to display support for a particular team. Fans of professional, collegiate, secondary school, community, little league or other teams may find the cover 104 permits the display of team pride or support. In other instances, the indicia may represent a company, an event name, or a sponsored event. Accordingly, the cover may serve a marketing or advertising purpose. It may include designs or simply text. Yet other embodiments are free from indicia and may be used solely for covering an ice chest for presentation purposes. Particular colors may be used to represent or match themes or events.

Persons of ordinary skill in the art will appreciate that the embodiments encompassed by the present disclosure are not limited to the particular exemplary embodiments described above. In that regard, although illustrative embodiments have been shown and described, a wide range of modification, change, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

I claim:

1. A one-piece ice chest cover for changing the appearance of an ice chest comprising:

a flexible main pocket portion having a front side, two lateral sides, and a back side forming a main pocket opening for receiving a main body of the ice chest; and a flexible lid pocket portion formed of an inner portion configured to face an inner-facing surface of a lid of the ice chest and an outer portion for covering an outer-facing surface of the lid, the lid pocket portion having a lid pocket opening sized smaller than a size of the main pocket opening, the lid pocket opening being sized to receive a portion of the lid of the ice chest, the outer portion of the lid pocket portion being connected to the back side of the main pocket portion so that the ice chest cover flexes when the lid is pivoted to open and close the ice chest.

2. The one-piece ice chest cover of claim 1, wherein the inner and outer portions of the lid pocket portion are sewn together at side edges and folded at a front edge to form the lid pocket portion.

3. The one-piece ice chest cover of claim 1, wherein the lateral sides of the main pocket portion are folded at an edge of one of the front side, a bottom, and the back side, and wherein the lateral sides of the main pocket portion are sewn to at least two of the front sides, the bottom, and the back side to form the main pocket portion.

4. The one-piece ice chest cover of claim 1, wherein the main pocket portion and the lid pocket portion are formed of a single, unitary material.

5. The one-piece ice chest cover of claim 1, wherein the main pocket portion and the lid pocket portion are formed of a fabric.

6. The one-piece ice chest cover of claim 5, wherein the fabric is a stretchable fabric.

7. The one-piece ice chest cover of claim 1, wherein the main pocket portion includes a bottom connected to the lateral sides, the front side, and the back side.

8. The one-piece ice chest cover of claim 1, wherein at least one of the lateral sides includes a handle-cutout sized to receive a handle of the ice chest.

9. The one-piece ice chest cover of claim 1, wherein the bottom includes a cut-out portion configured to accommodate wheels disposed at least in part along a bottom of the ice chest.

10. The one-piece ice chest cover of claim 1, further comprising a logo, name, or indicia disposed on at least one of the top of the flexible lid pocket portions and the front side to face outwardly when the cover is disposed on the ice chest.

11. The one-piece ice chest cover of claim 10, wherein the logo, name, or indicia comprises a team logo.

12. A one-piece ice chest cover for changing the appearance of an ice chest having a body and a lid attached at a connection, the one-piece ice chest cover comprising:

a main pocket portion formed of a stretchable fabric material, the main pocket portion having a front side, lateral sides, and a back side forming a main pocket opening sized to receive a body of the ice chest, the lateral sides being sewn to at least two of the front sides, the back side, and a bottom to form the main pocket portion; and a lid pocket portion configured to cover at least a top portion of the lid of the ice chest when the body of the ice chest is disposed within the main pocket portion, the lid pocket portion being formed of a stretchable fabric material and connected with and extending from the back side of the main pocket portion in a manner that covers the connection of the ice chest, the lid pocket portion having an outer portion and an inner portion folded to overlap each other, the outer portion and the inner portion each having side edges sewn together to form an opening to the lid pocket portion, the opening being sized to receive a portion of the lid of the ice chest.

13. The one-piece ice chest cover of claim 12, wherein the main pocket portion and the lid pocket portion are formed of a single, unitary material.

14. The one-piece ice chest cover of claim 12, wherein at least one of the lateral sides includes a handle-cutout sized to receive a handle of the ice chest.

15. The one-piece ice chest cover of claim 12, wherein the bottom includes a cut-out portion configured to accommodate wheels disposed at least in part along a bottom of the ice chest.

16. The one-piece ice chest cover of claim 12, further comprising a logo, name, or indicia disposed on at least one of the top of the flexible lid pocket portions and the front side to face outwardly when the cover is disposed on the ice chest.

17. The one-piece ice chest cover of claim 16, wherein the logo, name, or indicia comprises a team logo.

18. An assembly comprising:

an ice chest comprising:

a main body comprising front, a back, sides, and an opening for receiving items; and a lid pivotably connected to the main body, the lid having an outer facing surface and an inner facing surface and being shaped and sized to open and close to provide access into the main body portion;

an ice chest cover comprising:

a flexible main pocket portion having a front side, two lateral sides, and a back side forming a main pocket opening for receiving the main body of the ice chest; and a flexible lid pocket portion formed of an inner portion configured to face the inner facing surface of the lid and an outer portion for covering the outer facing surface of the lid, the lid pocket portion having a lid pocket opening sized smaller than a size of the main pocket opening, the lid pocket opening being sized to receive a portion of the lid, the outer portion of the lid pocket portion being connected to the back side of the main pocket portion so that the ice chest cover flexes when the lid is pivoted to open and close the ice chest.

19. The assembly of claim 18 wherein the inner and outer portions of the lid pocket portion are sewn together at side edges and folded at a front edge to form the lid pocket portion.

20. The assembly of claim 18, wherein the lateral sides of the main pocket portion are folded at an edge of one of the front sides, a bottom, and the back side, and wherein the lateral sides of the main pocket portion are sewn to at least two of the front sides, the bottom, and the back side to form the main pocket portion.

* * * * *